US006227826B1

(12) United States Patent
Lo

(10) Patent No.: US 6,227,826 B1
(45) Date of Patent: May 8, 2001

(54) DIAPHRAGM ACTIVATED COMPRESSION PUMP

(76) Inventor: Chi-Chung Lo, 29, Lane 654, Lung Nan Road, Ping Cheng, Taoyuan Hsien (TW)

( * ) Notice: Subject to any disclaimer, the term of this patent is extended or adjusted under 35 U.S.C. 154(b) by 0 days.

(21) Appl. No.: 09/412,337

(22) Filed: Oct. 5, 1999

(30) Foreign Application Priority Data

Sep. 9, 1999 (TW) ..... 88215371

(51) Int. Cl.[7] ..... F04B 39/10; F04B 17/00; F01B 19/00

(52) U.S. Cl. ..... 417/571; 417/413.1; 92/99

(58) Field of Search ..... 417/571, 413.1, 417/360; 92/98 R, 99

(56) References Cited

U.S. PATENT DOCUMENTS 3,289,547 * 12/1966 Kytta ..... 92/110
4,393,749 * 7/1983 Miyazaki ..... 92/99
4,571,160 * 2/1986 King et al. ..... 417/571
5,192,198 * 3/1993 Gebauer et al. ..... 92/98 R
5,863,184 * 1/1999 Juterbock et al. ..... 92/99

* cited by examiner

*Primary Examiner*—Charles G. Freay
*Assistant Examiner*—Michael K. Gray
(74) *Attorney, Agent, or Firm*—Dougherty & Troxell

(57) ABSTRACT

A leak-proof compression pump, which includes a base frame, a pressure cylinder fastened to the base frame, the pressure cylinder having a fluid chamber, a fluid inlet, and a fluid outlet, and a fluid pumping mechanism mounted in between the base frame and the pressure cylinder, the fluid pumping mechanism including an actuating member fixedly connected between the pressure cylinder and the base frame, the actuating member having an integrated semispherical diaphragm reciprocated in and out of the fluid chamber to draw fluid into the fluid chamber through the fluid inlet and to force fluid out of the fluid chamber through the fluid outlet, a reciprocating rod driven to reciprocate the diaphragm of the actuating member, and a supporting cup connected between the actuating member and the reciprocating rod for enabling the diaphragm of the actuating member to be moved in and out of the fluid chamber in the pressure cylinder.

6 Claims, 6 Drawing Sheets

DIAPHRAGM ACTIVATED COMPRESSION PUMP

BACKGROUND OF THE INVENTION

The present invention relates to pumps, and more particularly to a diaphragm activated compression pump, which produces little friction force during its pumping operation.

Conventional compression pumps have different designs including reciprocating type, rotary type, vane wheel type, or eddy flow type. Either of the known compression pump designs produces high friction force and heat. In order to minimize friction between parts, lubricating oil shall be applied. Further, because the fluid chamber in a convention compression pump is not kept in a perfect airtight condition, the fluid compression effect is not satisfactory.

SUMMARY OF THE INVENTION

The present invention has been accomplished to provide a compression pump, which eliminates the aforesaid drawbacks. It is one object of the present invention to provide a compression pump, which keeps the fluid chamber in a perfect airtight condition during its operation. It is another object of the present invention to provide a compression pump, which produces little friction force and heat during its operation. According to one aspect of the present invention, the compression pump comprises a base frame, a pressure cylinder fastened to the base frame, the pressure cylinder having a fluid chamber, a fluid inlet, and a fluid outlet, and a fluid pumping mechanism mounted in between the base frame and the pressure cylinder, the fluid pumping mechanism comprising an actuating member fixedly connected between the pressure cylinder and the base frame, the actuating member having an integrated semispherical diaphragm reciprocated in and out of the fluid chamber to draw fluid into the fluid chamber through the fluid inlet and to force fluid out of the fluid chamber through the fluid outlet, a reciprocating rod driven to reciprocate the diaphragm of the actuating member, and a supporting cup connected between the actuating member and the reciprocating rod for enabling the diaphragm of the actuating member to be moved in and out of the fluid chamber in the pressure cylinder. According to another aspect of the present invention, a first one-way valve is mounted in the fluid inlet for letting fluid pass from an external fluid source to the fluid chamber and preventing fluid from escaping out of the fluid chamber through the fluid inlet, and a second one-way valve is mounted in the fluid outlet for letting fluid pass out of the fluid chamber to the outside of the pressure cylinder through the fluid outlet and preventing fluid to flow back to the inside of the fluid chamber. According to still another aspect of the present invention, the pressure cylinder has a plurality of annular grooves at the back side wall of a rear flange thereof, and the actuating member of the fluid pumping mechanism has a plurality of coupling flanges respectively engaged into the annular grooves at the pressure cylinder to seal the gap between the pressure cylinder and the actuating member.

DETAILED DESCRIPTION OF THE PREFERRED EMBODIMENT

Figure 1:
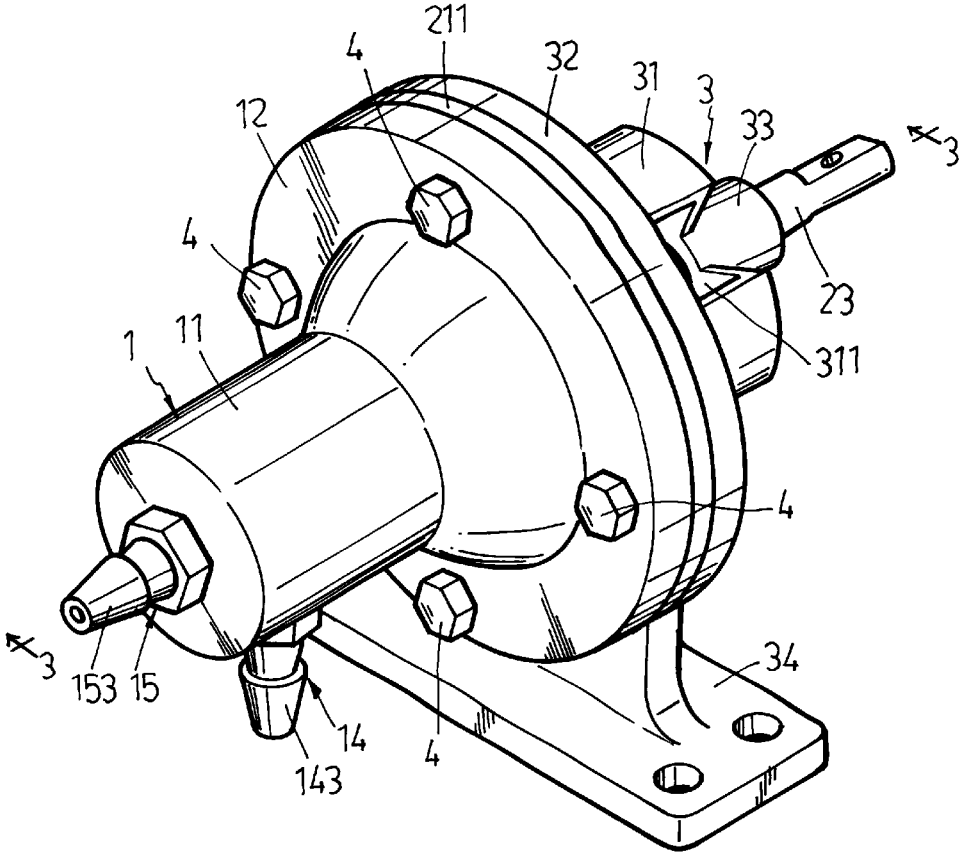
FIG. 1 is an elevational view of a diaphragm activated compression pump according to the present invention.
Figure 2:
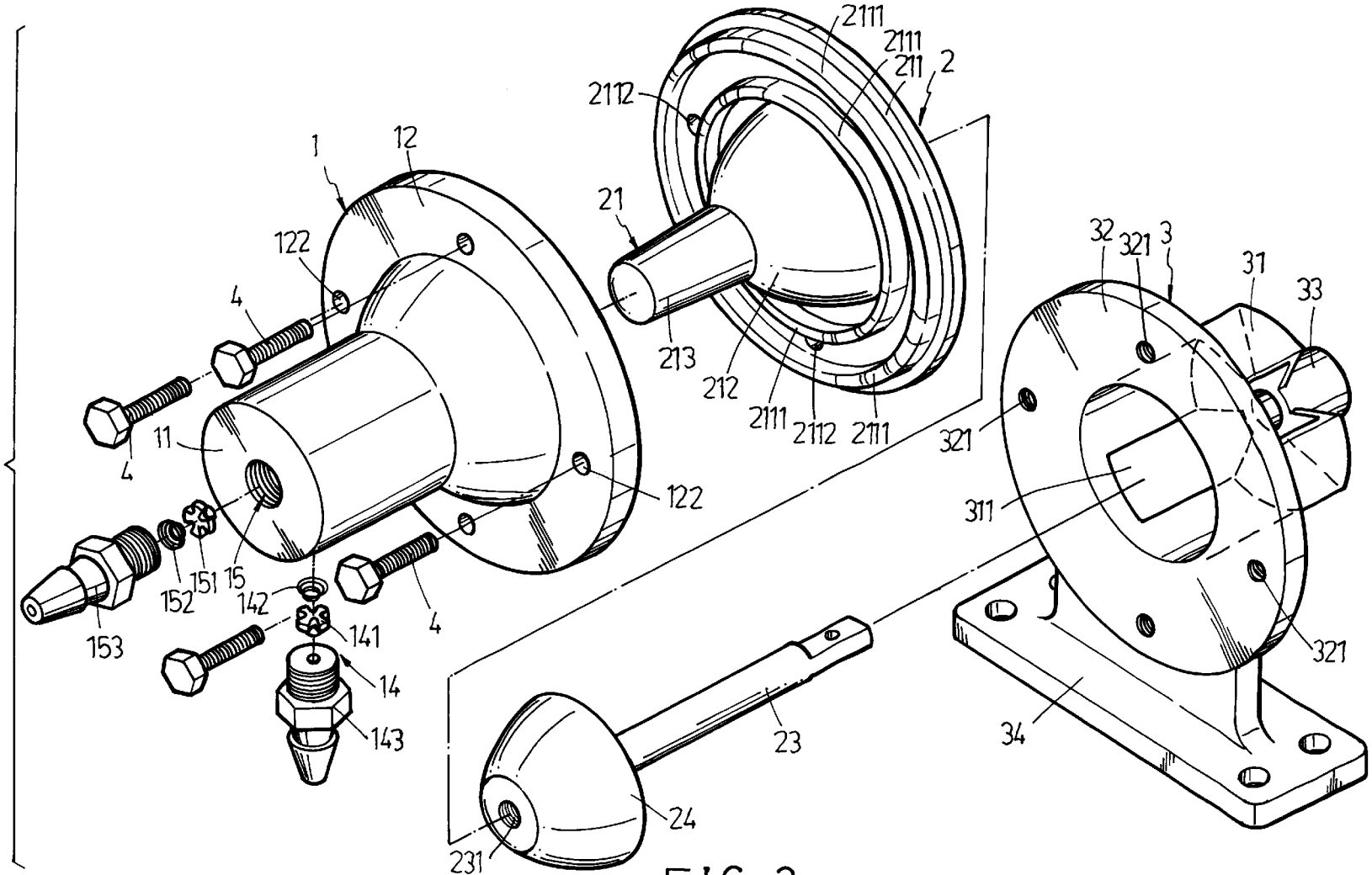
FIG. 2 is a perspective exploded view of the diaphragm activated compression pump shown in FIG. 1.
Figure 3:
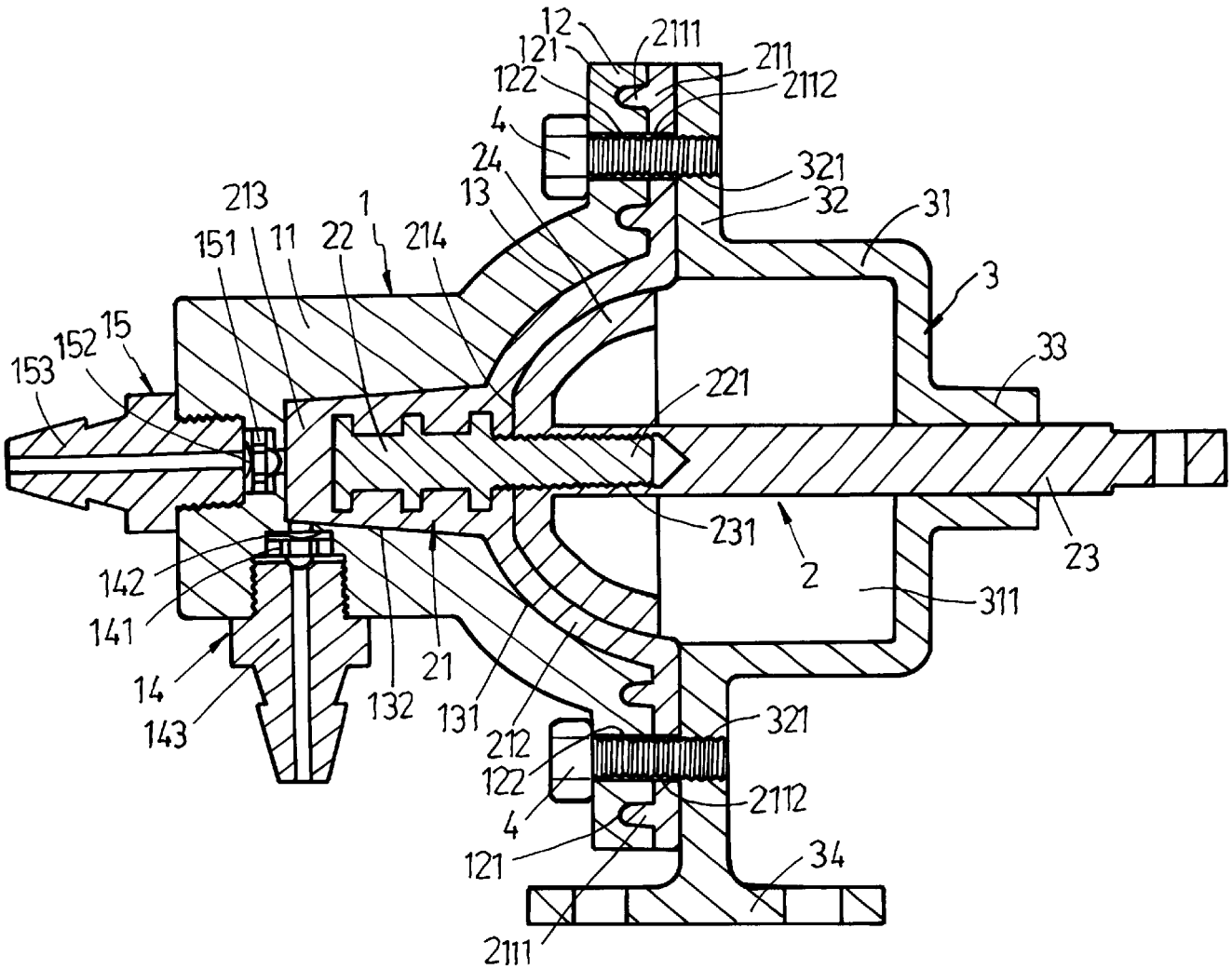
FIG. 3 is a sectional view of the diaphragm activated compression pump shown in FIG. 1.
Figure 4:
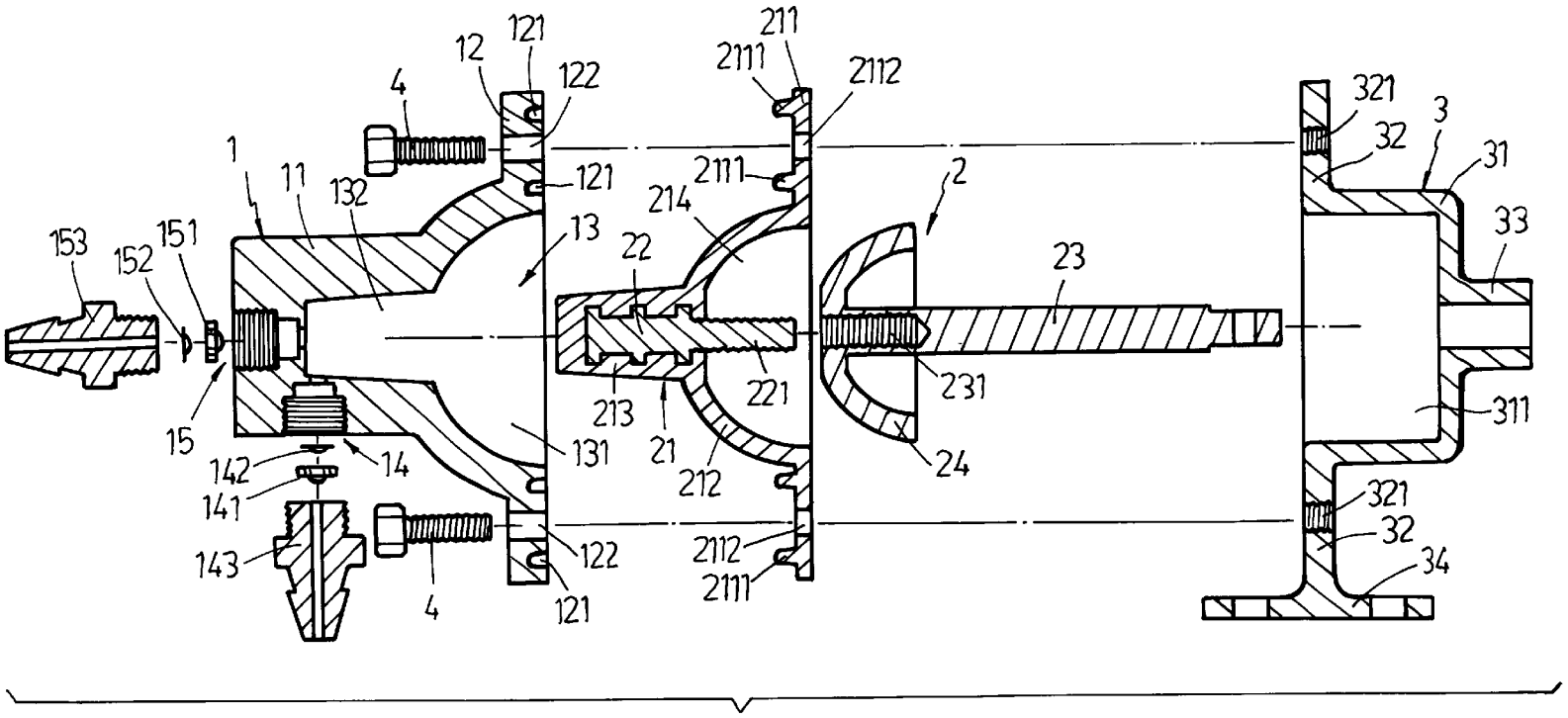
FIG. 4 is an exploded view in section of the diaphragm activated compression pump shown in FIG. 1.

Referring to FIGS. from 1 through 4, a diaphragm activated compression pump in accordance with the present invention is generally comprised of a pressure cylinder 1, a fluid pumping mechanism 2, and a base frame 3.

The pressure cylinder 1 comprises a cylindrical body 11, a flange 12 formed integral with one end of the body 11, a fluid chamber 13 defined within the body 11 and the flange 12, a stepped fluid inlet 14 pierced through the peripheral wall of the body 11 and disposed in communication with the fluid chamber 13, a stepped fluid outlet 15 axially pierced through the body 11 at the center and disposed in communication with the fluid chamber 13, at least one, for example, two annular grooves 121 concentrically formed on the back side wall of the flange 12, and a plurality of mounting holes 122 axially extended through the flange 12. The fluid chamber 13 comprises a front compression space 132 defined within the body 11 and disposed in communication with the stepped fluid inlet 14 and the stepped fluid outlet 15, and a rear semispherical actuating space 131 defined within the flange 12. The rear actuating space 131 of said fluid chamber 13 is a semispherical space having a diameter gradually backwardly increased from said front compression space 132 toward said base frame 3. The front compression space 132 is a tapered cylindrical space, having a diameter gradually reduced from the rear actuating space 131 toward the stepped fluid outlet 15. A one-way valve 141 is supported on a spring element 142 in the stepped fluid inlet 14 for guiding fluid into the fluid chamber 13. A pipe connector 143 is fastened to the stepped fluid inlet 14 outside the body 1 for receiving an inlet pipe from a fluid source (not shown). When fluid passes through the one-way valve 141, the one-way valve 141 is simultaneously forced against the spring element 142, causing the spring element 142 to be compressed (see FIG. 5). When fluid flows reversely from the fluid chamber 13 into the stepped fluid inlet 14, the one-way valve 141 is forced outwards, causing the semispherical end portion of the one-way valve 141 to stop the passage of the pipe connector 143, and therefore fluid is stopped from flowing out of the pipe connector 143 (see FIG. 6). A oneway valve 151 is mounted in the stepped fluid outlet 15 for guiding fluid out of the fluid chamber 13. A pipe connector 153 is fastened to the stepped fluid outlet 15 outside the body 1 for receiving an outlet pipe (not shown), for enabling compressed fluid to be delivered from the fluid chamber 13 to the desired location through the outlet pipe. A spring element 152 is mounted in the stepped fluid outlet 15, and connected between the one-way valve 151 and the pipe connector 153. When fluid flows out of the fluid chamber 13 through the stepped fluid inlet 14, the one-way valve 151 is forced to compress the spring element 152, enabling fluid to pass through the stepped fluid outlet 15 (see FIG. 6). On the contrary, when the fluid pumping mechanism 2 is moved backwards to draw fluid into the fluid chamber 13 through the stepped fluid inlet 14, the one-way valve 151 is sucked inwards, causing the spherical end portion of the one-way valve 151 to close the passage of the fluid outlet 15 (see FIG. 5).

Referring to FIGS. from 1 through 4, the fluid pumping mechanism 2 is comprised of an actuating member 21, a mounting rod 22, a reciprocating rod 23, and a rigid supporting cup 24. The supporting cup 24 being connected between the mounting rod 22 and the reciprocating rod 23. The actuating member 21 comprises a flat mounting base 211, an axially forwardly extended front cylindrical portion 213, and a semispherical compressive diaphragm 212 connected between the flat mounting base 211 and the front cylindrical portion 213. The front cylindrical portion 213 fits the front compression space 132 of the fluid chamber 13. The semispherical compressive diaphragm 212 fits the peripheral wall of the rear actuating space 131 of the fluid chamber 13, having a semispherical chamber 214 for receiving the supporting cup 24. The mounting rod 22 is fixedly axially fastened to the front cylindrical portion 213 inside the actuating member 21, having a threaded rear end 221 suspended in the chamber 214 defined within the semispherical compressive diaphragm 212. The flat mounting base 211 comprises two endless coupling flanges 2111 raised from the front side wall thereof and respectively engaged into the annular grooves 121 at the flange 12 of the pressure cylinder 1, a plurality of through holes 2112 respectively aimed at the mounting holes 122 at the flange 12 of the pressure cylinder 1. The supporting cup 24 fits the inside wall of the diaphragm 212, comprising a screw hole 231 axially disposed at the center of the front side thereof and threaded onto the threaded rear end 221 of the mounting rod 22. The reciprocating rod 23 has one end fixedly connected to the center of the supporting cup 24 at the backside.

Referring to FIGS. from 1 through 4 again, the base frame 3 comprises a flat bottom plate 34 for mounting, an annular supporting plate 32 raised from the flat bottom plate 34, a hollow cylindrical shell 31 formed integral with the inner diameter of the annular supporting plate 32 and defining a chamber 311, and an axle sleeve 33 formed integral with the cylindrical shell 31 at the center. The annular supporting plate 32 comprises a plurality of screw holes 321. A plurality of tie screws 4 are respectively mounted in the mounting holes 122 at the flange 12 of the pressure cylinder 1 and the through holes 2112 at the flat mounting base 211 of the actuating member 21, and threaded into the screw holes 321 at the annular supporting plate 32 of the base frame 3 to secure the pressure cylinder 1 and the actuating member 21 to the base frame 3, enabling the reciprocating rod 23 to be inserted through the axle sleeve 33 and connected to a motor drive 5 (see also FIG. 5).

Figure 5:
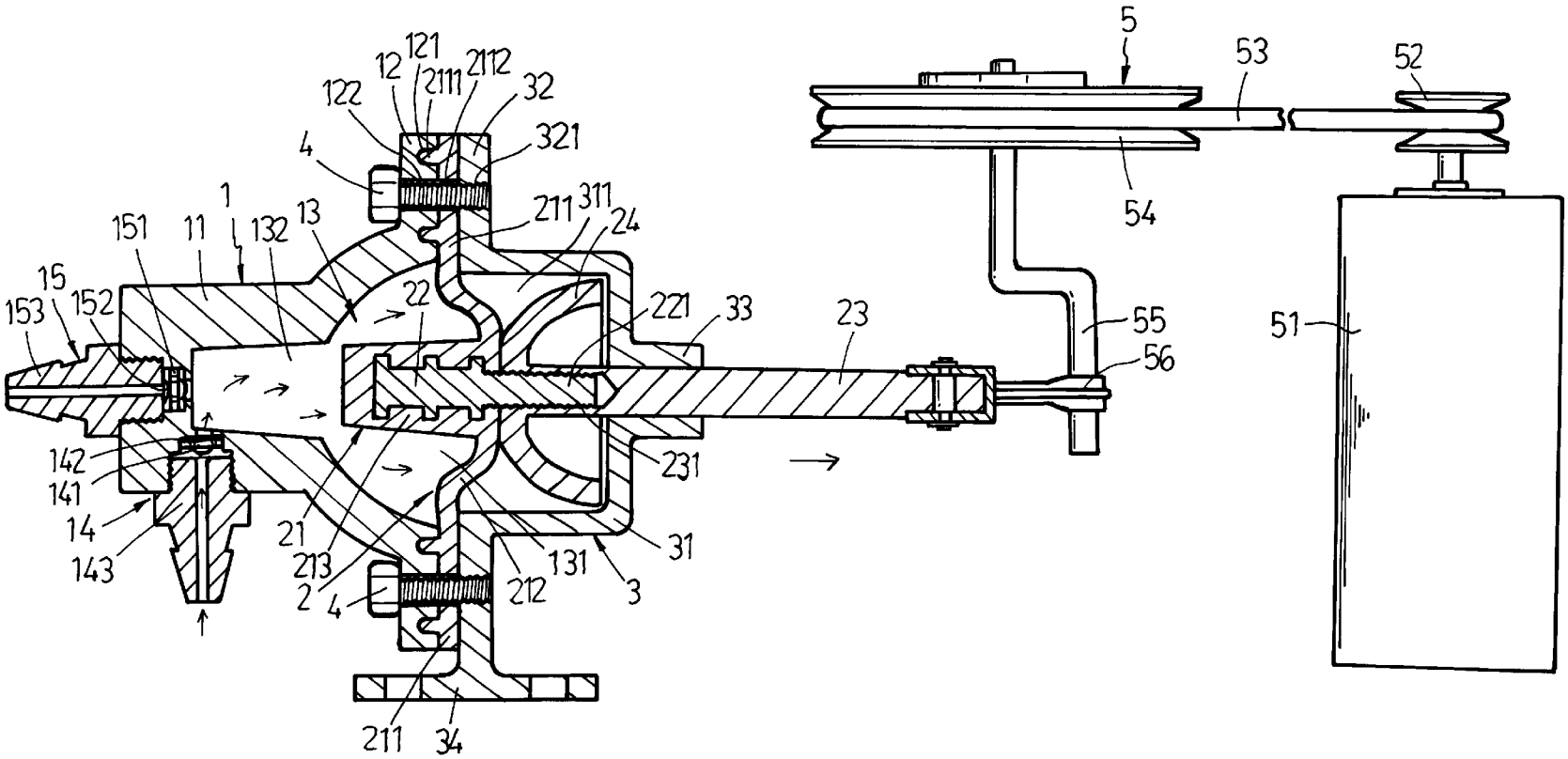
FIG. 5 is a sectional view of the present invention, showing liquid drawn into the pump.
Figure 6:
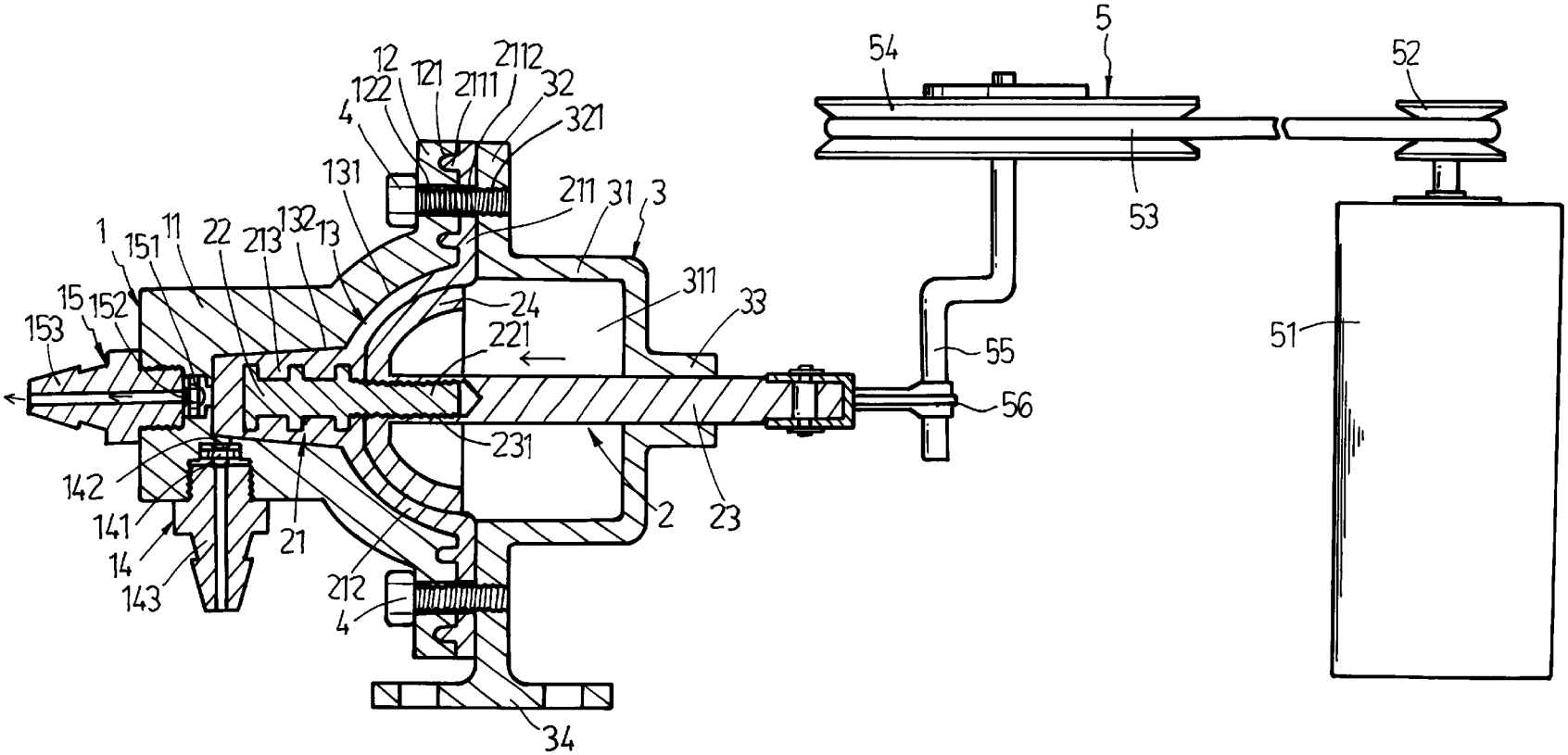
FIG. 6 is a sectional view of the present invention, showing liquid driven out of the pump.

Referring to FIGS. 5 and 6, the motor drive 5 comprises a motor 51, a driving wheel 52 coupled to the output shaft of the motor 51, a driven wheel 54, a transmission belt 53 coupled between the driving wheel 52 and the driven wheel 54, a crank 55 fixedly connected the wheel center of the driven wheel 54, and a link 56 coupled between the crank 55 and the reciprocating rod 23. When the motor 51 is started, the crank 55 is rotated with the driven wheel 54, thereby causing the reciprocating rod 23 to be reciprocated by the link 56. When the reciprocating rod 23 is moved backwards, the front cylindrical portion 213 and the mounting rod 22 are moved backwards with the reciprocating rod 23, thereby causing the diaphragm 212 to be curved inwards (see FIG. 5). When the diaphragm 212 is curved inwards, a suction force is produced in the fluid chamber 13 to draw fluid into the fluid chamber 13 through the one-way valve 141 in the fluid inlet 14. On the contrary, when the reciprocating rod 23 is moved forwards, the front cylindrical portion 213 is forced into the front compression space 132 in the fluid chamber 13 by the supporting cup 24 and the reciprocating rod 23, and at the same time the diaphragm 212 is forced forwards into the rear actuating space 131 of the fluid chamber 13 by the supporting cup 24, thereby causing fluid to be compressed and squeezed out of the fluid chamber 13 through the one-way valve 151 in the fluid outlet 15. Because the actuating member 21 is not rubbed against the inside wall of the pressure cylinder 1 when reciprocated, little friction force is produced during the operation of the pump. Therefore, this design of pump eliminates the application of lubricating oil, and is practical for use to pump fluid, gas, or mixed fluid.

While only one embodiment of the present invention has been shown and described, it will be understood that various modifications and changes could be made thereunto without departing from the spirit and scope of the invention disclosed.

What the invention claimed is:

1. A diaphragm activated compression pump comprising:

a base frame, said base frame comprising a flat bottom plate for mounting, an annular supporting plate raised from said flat bottom plate, a hollow cylindrical shell formed integral with said annular supporting plate and defining a chamber, and an axle sleeve formed integral with said cylindrical shell;

a pressure cylinder fixedly fastened to the annular supporting plate of said base frame, said pressure cylinder comprising a cylindrical body, a flange formed integral with one end of said body and fixedly fastened to the annular supporting plate of said base frame, a fluid chamber defined within said body, a fluid inlet for guiding fluid into said fluid chamber, a first one-way valve mounted in said fluid inlet for enabling fluid to pass from an external fluid source to said fluid chamber, a fluid outlet for guiding fluid out of said fluid chamber, and a second one-way valve mounted in said fluid outlet for letting fluid pass from said fluid chamber to the outside of said pressure cylinder, said fluid chamber comprising a cylindrical front compression space and a rear actuating space; and a fluid pumping mechanism mounted in between said base frame and said pressure cylinder and reciprocated to draw fluid from said first one-way valve in said fluid inlet into said fluid chamber and to pump fluid out of said fluid chamber to the outside of said pressure cylinder through said second one-way valve in said fluid outlet, said fluid pumping mechanism comprising an actuating member, a mounting rod, a reciprocating rod, and a rigid supporting cup, said actuating member comprising a flat mounting base fixedly connected between the flange of said pressure cylinder and the annular supporting plate of said base frame, an axially forwardly extended front cylindrical portion moved in and out of the front compression space of said fluid chamber, and a compressive diaphragm connected between said flat mounting base and said front cylindrical portion and moved in and out of the rear actuating space of said fluid chamber, said mounting rod being fixedly axially fastened to said front cylindrical portion and suspended inside said actuating member, said supporting cup being connected between said mounting rod and said reciprocating rod, said reciprocating rod having one end connected to said supporting cup and an opposite end inserted through said axle sleeve of said base frame for connection to an external drive means.

2. The diaphragm activated compression pump of claim 1 wherein the front compression space of said fluid chamber has a diameter gradually reduced from said rear actuating space toward said fluid outlet, and the front cylindrical portion of said actuating member fits the front compression space of said fluid chamber.

3. The diaphragm activated compression pump of claim 1 wherein said the rear actuating space of said fluid chamber is a semispherical space having a diameter gradually backwardly increased from said front compression space toward said base frame.

4. The diaphragm activated compression pump of claim 1 wherein said diaphragm is a hollow semispherical member integrally connected between said flat mounting base and said front cylindrical portion.

5. The diaphragm activated compression pump of claim 1 wherein said diaphragm defines a semispherical space for receiving said supporting cup.

6. The diaphragm activated compression pump of claim 1 wherein the flange of said pressure cylinder comprises at least one annular groove at a back sidewall thereof, and the mounting base of said actuating member comprises at least one coupling flange raised from a front side wall thereof and respectively engaged into the at least one annular groove at the flange of said pressure cylinder.

* * * * *